US005355928A

United States Patent [19]

Robertson

[11] Patent Number: 5,355,928

[45] Date of Patent: Oct. 18, 1994

[54] ROMAN SHADE AND METHOD OF CONSTRUCTION

[75] Inventor: Richard W. Robertson, Arvada, Colo.

[73] Assignee: D.S.C. Fabrics, Inc., Arvada, Colo.

[21] Appl. No.: 131,371

[22] Filed: Oct. 4, 1993

[51] Int. Cl.[5] ..... E06B 9/06

[52] U.S. Cl. ..... 160/84.1 R; 160/348

[58] Field of Search ..... 160/84.1 C, 84.1 R, 160/264, 330, 348

[56] References Cited

U.S. PATENT DOCUMENTS

| | | | |
|---|---|---|---|
| 1,752,610 | 4/1930 | McSpadden | 160/84.1 C |
| 3,777,800 | 12/1973 | Susoev . | |
| 4,069,857 | 1/1978 | Brookshire . | |
| 5,123,473 | 6/1992 | Henkenjohann | 160/264 |

FOREIGN PATENT DOCUMENTS

| | | | |
|---|---|---|---|
| 674059 | 4/1939 | Fed. Rep. of Germany | 160/84.1 C |
| 2441178 | 4/1975 | Fed. Rep. of Germany | 160/264 |
| 543937 | 3/1942 | United Kingdom | 160/84.1 C |

*Primary Examiner*—Blair M. Johnson

*Attorney, Agent, or Firm*—Fields, Lewis, Pittenger, Rost & Smith

[57] ABSTRACT

A Roman shade having a plurality of rearwardly extending vertically spaced horizontal pleats uses plastic retaining means adhesively bonded to the outer surfaces of the pleats and eyelets to precisely and durably maintain the pleats. The shade includes bodies of flexible facing and backing materials integrally segmented by folding portions of the material into pleat segments to form the pleats. Plastic strips having vertically aligned openings are adhesively secured to the outside surfaces of the pleats and interconnected by eyelets extending through the openings. Engaging surfaces of the eyelets engage the plastic strips further securing strips to the pleat outer surfaces. Edge borders of facing and backing material formed of back folded edge portions of said facing and backing material adhesively secured to itself, combined with disclosed pleat design, obviate need for sewing during construction.

11 Claims, 2 Drawing Sheets

ROMAN SHADE AND METHOD OF CONSTRUCTION

TECHNICAL FIELD

This invention relates to the fabrication of Roman shades and more particularly to a device within the above mentioned class of improved construction utilizing efficient and precise pleat retainment.

BACKGROUND OF THE INVENTION

Roman shades are of the type characterized by being segmented and pleated wherein the shade may be opened and closed by progressively raising and lowering the segmented body from the lowermost segment. The pleats used in conventional Roman shade designs utilize such means as metal and wooden slats to maintain the straightness of the horizontal folds into which the shade segments are gathered when the shade is being raised or lowered. The shades are generally drawn with pull strings guided by string guides. Conventional Roman shades pose challenges in their method of manufacture and are sometime awkward to handle and to assemble or disassemble. The method of manufacture of such shades has evolved to some extent because of the relatively large number of steps in known manufacturing techniques, including the sewing of material to make the facing body of the shade, methods of securing the shades to string guides and drawstrings, and the method of manufacture of the pleats. Improvements in construction have been achieved as exemplified in U.S. Pat. No. 3,777,800 to Susoev and U.S. Pat. No. 4,069,857 to Brookshire. However, as exemplified by these patents, the former requires the use of battens and stitched pockets for receiving the battens and the latter requires the use of a plastic sheet material in its method of construction. A need still exists for a shade which provides an improved durable pleat retention assembly neither requiring sewing or other tedious processes in its construction nor limiting the facing material to a plastic sheet. It is important that the shade construction results in a precise shade having straight and durable folds and pleats.

It is an object of this invention to provide a shade design with the aforementioned characteristics and which yields substantial savings in manufacturing material and labor costs. It is a specific object of this invention to provide an improved manner of pleat retainment utilizing inexpensive material and an efficient method of construction thereof. It is a further object of this invention to provide an aesthetically pleasing design for the Roman shade.

DISCLOSURE OF THE INVENTION

In accordance with this invention, a Roman shade has been provided which utilizes efficient and highly effective pleat retaining means to maintain the horizontal folds of the shade. More particularly, a Roman shade constructed in accordance with this invention is provided with a body of flexible facing material having a front facing side and a rear side. A plurality of horizontal pleats vertically spaced from one another extend from the rear side of the body. Each pleat is formed of a pair of rearwardly extending first and second folded segments of the facing material body. The segments' front facing sides adjacently face towards one another inside the pleat and the segments' rear facing sides face away from one another to form the outside surfaces of the pleat. Provided plastic retaining means, adhesively secured to the outside surfaces of each pleat, hold the two segments together from the outside pleat surfaces to securely maintain the pleat. Raising means are provided which cooperate with the plastic retaining means to vertically lower and raise the shade progressively from the lowermost pleat.

In a preferred embodiment of the present invention, the plastic retaining means includes first and second plastic strips having corresponding vertically aligned openings. The first plastic strip is adhesively secured to the outside surface of the first pleat segment and the second plastic strip is adhesively secured to the outside surface of the second pleat segment. Eyelets extend through each pair of the corresponding vertically aligned openings and the pleat material therebetween. The eyelets have first and second ends; a first engaging surface extends from the first end to engage the first plastic strip and a second engaging surface extends from the second end to engage the second plastic strip. The eyelet engaging surfaces thus further secure the plastic strips to the outside surfaces of the pleat segments to further maintain the pleat.

In another preferred embodiment of the present invention, a body of flexible backing material having a front side and a back side is provided. The front side of the backing material body is adhesively secured to the rear side of the facing material body and folded into pleat segments. The back side of the pleat segments thus form the outside surfaces of the pleat in this arrangement with the plastic strips adhesively secured thereto so that the backing material pleat segments are also held within the plastic strips. Alternatively, the front sides of the backing material pleat segments may be adhesively secured over the plastic strips to cover the plastic strips. The engaging surfaces of the eyelets in this configuration also engage the back sides of the backing material pleat segments.

Edge borders of the facing material, including the bottom hem pocket, are formed from edge portions of the facing material folded back and adhesively secured to the rear side of the material. This allows the shade to be completely constructed without the need for any sewing.

In one embodiment of the present invention, the provided raising means includes pulley means and a draw string extending through each column of eyelets. The draw string has two ends and cooperates with the pulley means to allow the shade to be raised or lowered by drawing the first end. The second end is provided with means for abutting it against the lowermost eyelet so that the shade is capable of being lowered or raised by drawing the first end.

The present invention also provides a method of constructing a Roman shade. A body of flexible facing material having a front facing side and a rear side is provided. Portions of the facing material body are folded to form a plurality of rearwardly extending two segment horizontal pleats vertically spaced from one another such that the segments' front facing sides adjacently face each other inside of the pleat and the rear sides of the segments face away from each other forming the outside surfaces of the pleat. Plastic retaining means for holding the folded pleat segments together to maintain the pleat are provided and adhesively secured to the outside surfaces of each pleat.

The provided plastic retaining means includes first and second plastic strips having corresponding openings vertically aligned with one another. The first plastic strip of said pair is adhesively secured to the outside surface of the first pleat segment and the second plastic strip of said pair is adhesively secured to the outside surface of the second pleat segment in each pleat.

Eyelets are provided having two opposed ends with a first engaging surface extending from one end and material extending from the other end to form a second engaging surface. Openings are punched in the pleat segment facing material to correspond with the openings in the plastic strips. The eyelets are pushed through the corresponding openings in the first strip, the pleat segment facing material and the second strip so that the first engaging surface engages the first strip. The second engaging surface material is crushed to form a second engaging surface which engages the second plastic strip thus interconnecting the plastic strips and further securing the strips to the outside surfaces of the pleat segments.

A body of flexible backing material may also be provided and adhesively secured to the rear side of the facing material. Pleat segments of the backing material are folded with the facing material pleat segments such that the back sides of the backing material pleat segments form the outside surfaces of the pleat. The plastic strips are adhesively secured thereto so that the backing material pleat segments are also held within the plastic strips. Openings are also punched in the backing material for the eyelet to also be pushed therethrough. Alternatively the front side of the backing material pleat segments may be adhesively secured over the plastic strips to cover the plastic strips so that the engaging surfaces of the eyelets engage the back sides of the backing material pleat segments.

Further steps in the method include: folding back edge portions of said facing material and adhesively securing the rear side of the folded back edge portions to the rear side of the facing material to form margins and hem pockets for the shade; and providing and installing raising means cooperating with a plurality of the retaining means for progressively lowering and raising the shade from the lowermost pleat. In one embodiment of the present invention, the step of installing the raising means includes the steps of providing and installing pulley means. A draw string having two ends is provided, strung through each vertically aligned column of eyelets, and installed on the pulley means such that the first end of the draw string cooperates with the pulley means to control the raising and lowering of the shade. Means for abutting the lowermost eyelet is provided and installed on the second end of the drawstring to prevent it from going through the lowermost eyelet when pulled on by the first end, thus allowing the shade to be controlled by the first end.

With this construction, the advantages of this invention are readily apparent. A Roman shade is disclosed of simple and efficient construction yielding substantial material and labor savings. The shade utilizes plastic pleat retaining means, adhesive, and eyelets to sandwich two pleat segments from their outside surfaces to securely form and maintain a rearwardly extending pleat. The construction obviates the need for stitching battens to the pleats, forming batten pockets, or utilizing heat sealing or a thermoplastic facing material in the construction of the shade as here to now taught. Additional advantages of this invention will become apparent from the description which follows, taken in conjunction with the accompanying drawings.

BEST MODE FOR CARRYING OUT THE INVENTION

In accordance with one form of this invention, a pleated Roman shade 10 can be made from a body of flexible facing material, such as patterned drapery fabric, without any stitching utilized in its construction thus reducing the time and cost of construction while still maintaining overall precision and straightness in its pleats and edges. The construction allows the use of various drapery fabrics or other flexible facing materials without regard for harshness on sewing needles or breakage thereof since its construction utilizes only plastic strips, adhesives and eyelets to maintain its borders and pleats.

Figure 1:
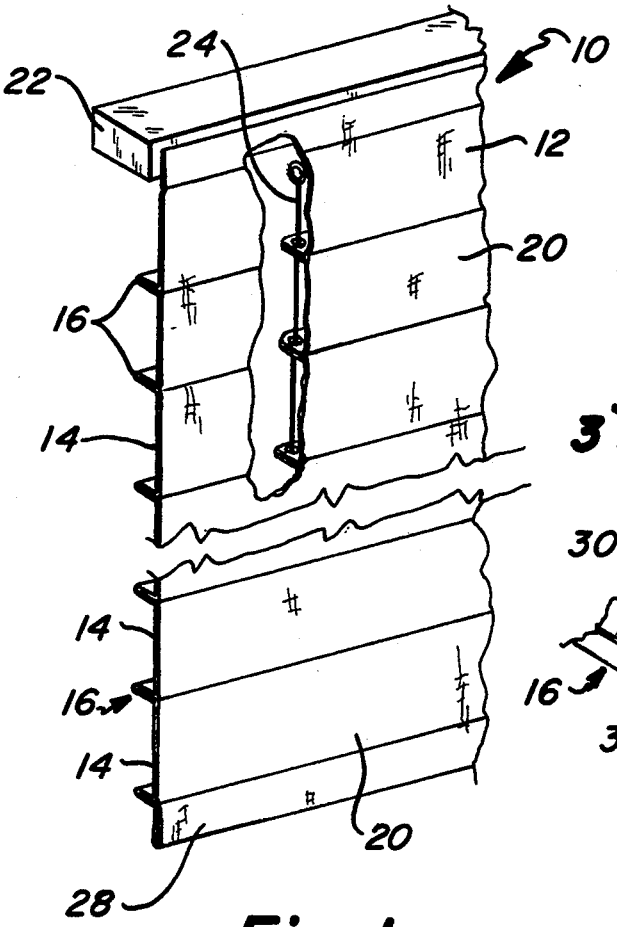
FIG. 1 is a perspective view showing the front side of the facing body of one embodiment of a Roman shade of the present invention with a portion cut away to show the drawstring and eyelets in the pleats.

In accordance with one form of this invention, as shown in FIG. 1, a Roman shade 10 is provided with a body 12 of flexible facing material or flexible facing body having a number of body panels or segments 14, each adjacent pair of segments being separated by a pleat 16 extending from the rear side 18 of the body 12. The front or facing side 20 of the body 12 presents for viewing the ornamentation and design on the fabric, or other flexible material from which the body 12 is constructed. Any number of textures or materials can be used for the front or facing side 20 of the facing material body 12. Most fabrics commercially available have a single displayable facing side.

The segments 14 of the body 12 extend from a conventional top channel-shaped header 22. A topmost pleat 16 is inserted into a channel (not shown) in the header 22 and housed therewithin. A drawstring 24 in conjunction with a pulley system (not shown) within the header 22 is conventionally used to raise and lower the segments 14 progressively from the lowermost pleat 16. Drawstring 24 extends through eyelets 26 housed in the pleat 16, as shown in FIG. 1. A weighted hem pocket 28 is provided at the bottom of the body 12 to keep the body 12 taught. The hem pocket 28 is formed from folding the lowermost edge of the body and adhesively securing the hem to the rear side 18 of the body 12. The hem pocket 28 may also be secured within the lowermost pleat, as will be described in greater detail herein.

Figure 2:
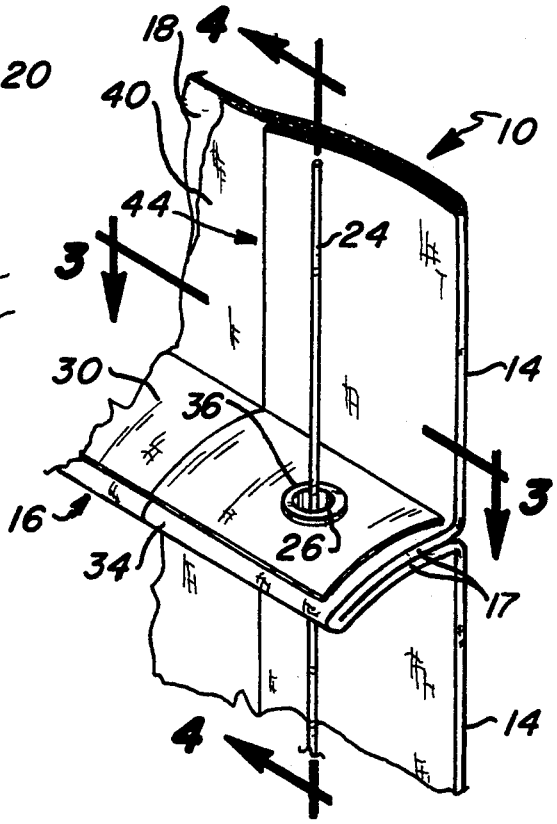
FIG. 2 is an enlarged perspective view showing the rear side of the facing body and the rear extending pleats of the Roman shade of FIG. 1.
Figure 3:
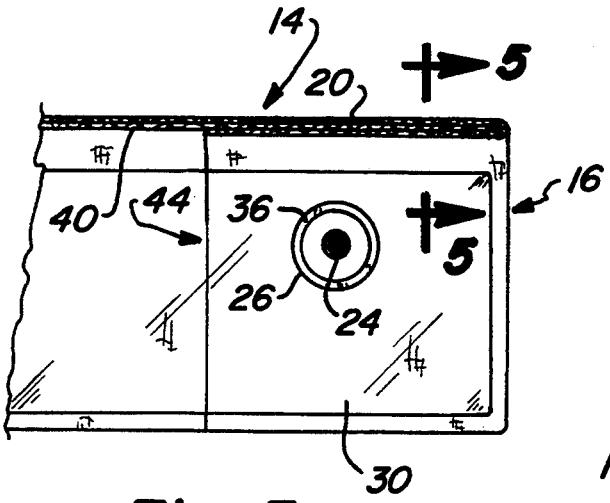
FIG. 3 is an enlarged partial horizontal section, taken along the lines 3—3 in FIG. 2, showing a plastic retaining strip and the eyelet therethrough.

As shown in FIG. 2, in its simplest form, each pleat 16 is formed by rearwardly folding a portion of the facing material body 12 into two pleat segments 17. The pleat segments 17 are folded such that the facing sides thereof face toward each other with the pleat extending from the rear side 18 of the body 12. The pleats 16 integrally divide the body 12 into adjacent body segments 14. A plastic retaining means, such as upper retainer strip 30 and lower retainer strip 32, adhesively secured to the top and bottom portion of outside surface 34, respectively, of the pleat 16 permanently maintains the pleat. The curved plastic strips 30 and 32 may be made from any suitable polymer based material capable of adhesively bonding to the pleat segments. The strips may also be flexible to conform to small thickness variations or bends in the pleats 16. Each pair of plastic strips 30 and 32 have sets of vertically aligned openings. These sets, as shown in FIG. 1, correspond to one another from pleat to pleat, thus forming columns of vertically aligned openings.

An eyelet 26 extends through each pair of vertically aligned openings in each pair of plastic strips 30 and 32 and through corresponding openings punched into the pleat segments of the material body 12. The eyelets 26 have top and bottom lips 36 and 38, respectively, which engage the plastic strips 30 and 32 to further secure the strips to the outside surface 34 of the pleat 16. The eyelets may be made from a suitable deformable metal such as aluminum. The drawstring 24 extends through a column of vertically aligned eyelets from the topmost to the bottommost pleat and terminates in a button (not shown) or other means to abut it to the bottom lip of the lowermost eyelet so that the pleats 16 may be raised or lowered without the drawstring 24 slipping through an eyelet.

Figure 4:
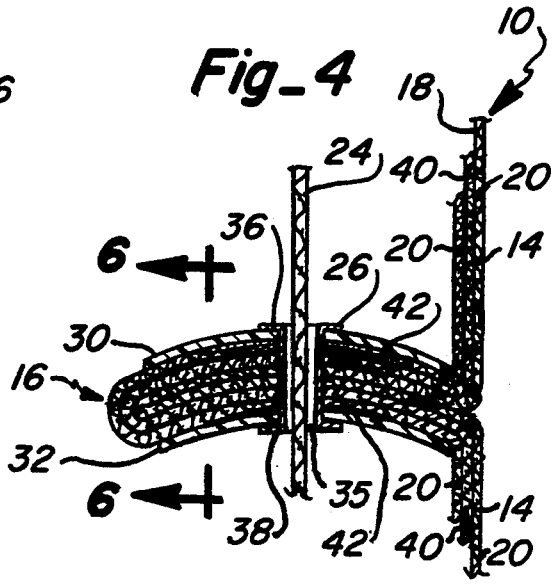
FIG. 4 is an enlarged vertical section, taken along the line 4—4 in FIG. 3 showing the retainment of the pleat and the layers thereof.
Figure 5:
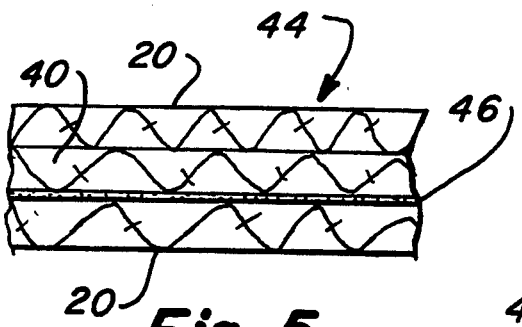
FIG. 5 is an enlarged vertical section, taken along the line 5—5 in FIG. 3, showing a side hem.
Figure 6:
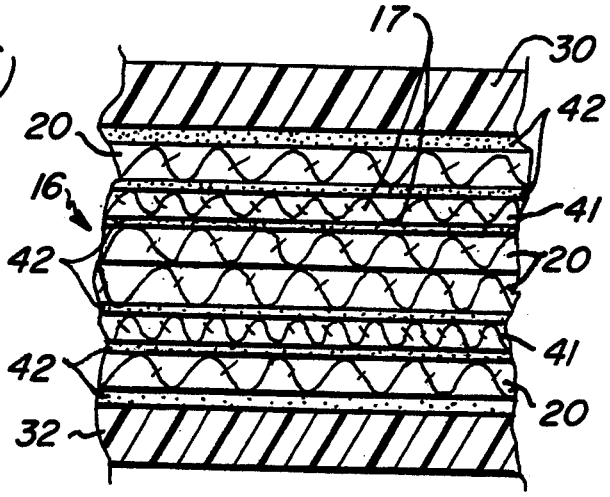
FIG. 6 is an enlarged vertical section, taken along the line 6—6 in FIG. 4, showing the layers in a pleat.

As shown in FIGS. 4 and 6, a flexible backing material body 40 is applied to the rear side 18 of the facing material body 12 to protect the facing body 12. The backing material may be made of conventional fabric, vinyl based, or other suitable backing material capable of bonding with adhesive. The backing material body 40 is adhesively bonded to the rear side 18 of the facing material body 12, thus removing the need to perform any sewing or stitching operations. In this configuration, portions of the backing material body 40 are folded into pleat segments 41 along with the facing material pleat segments 17 to form the pleat 16. Each pleat, as best shown in FIG. 6, is formed in a series of adhesively bonded elements and layers listed, from top to bottom, as follows: a first plastic strip 30; an adhesive layer 42; a backing material pleat segment 41; an adhesive layer 42; a facing material pleat segment 17; a second facing material pleat segment 17; an adhesive layer 42; a backing material pleat segment 41; an adhesive layer 42; and a plastic strip 32. As shown, all of these elements and layers are further retained by the top and bottom lips 36 and 38, respectively, of eyelet 16. The adhesive layers 42 may be made from suitable adhesives having high bonding strength qualities without damaging the bonded material.

While not shown, a side hem may be formed by folding the longitudinal outside edge of the Roman shade back upon itself. A suitable adhesive layer 46 is provided to hold this hem in place without the need of stitching, thereby saving the labor cost of sewing this edge.

Figure 7:
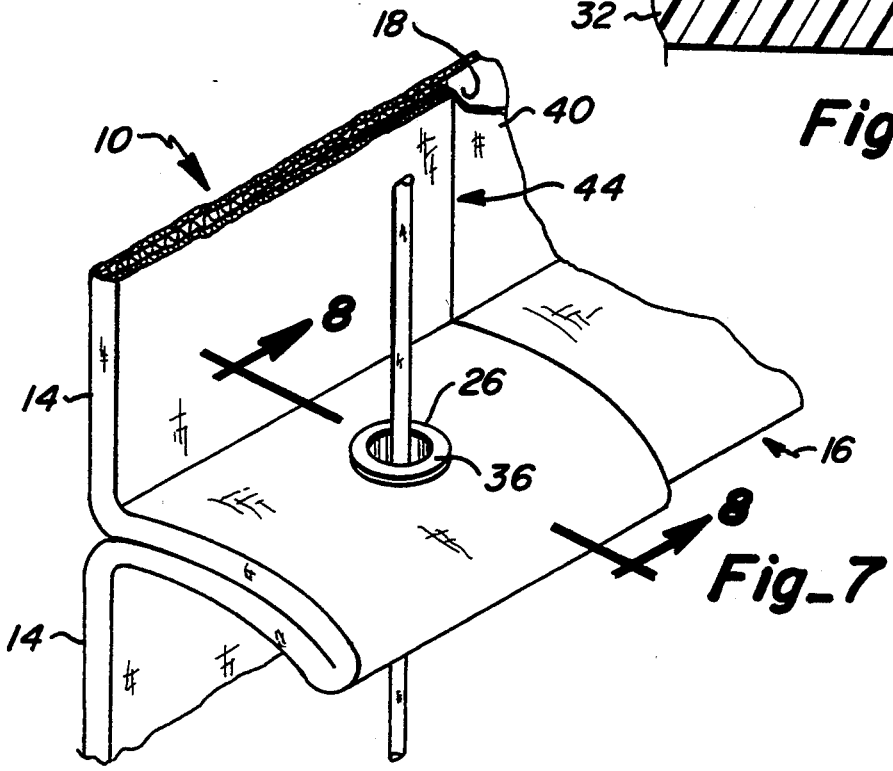
FIG. 7 a partial perspective view of an alternate pleat construction of the present invention.
Figure 8:
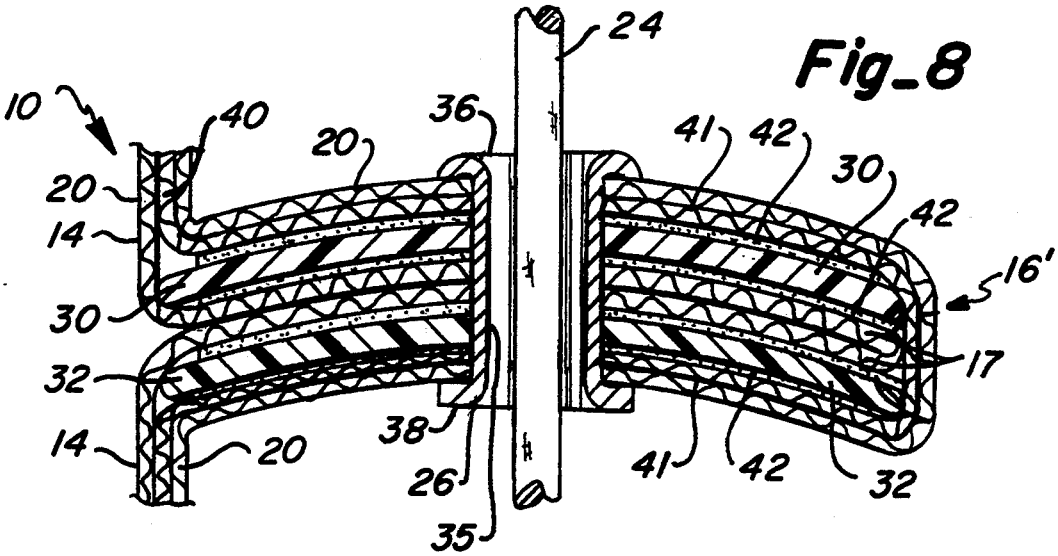
FIG. 8 is an enlarged partial section, taken along the line 8—8 in FIG. 7, showing the layers in the alternate pleat.

In an alternate embodiment of the present invention, shown in FIGS. 7 and 8, a pleat 16' has backing material pleat segments 41 which are not enclosed within the plastic strips 30 and 32, but are adhesively bonded to the outside surfaces of strips 30 and 32, respectively, to generally cover them. The backing material pleat segments 40 are further secured to the plastic strips 30 and 32, respectively, by the top and bottom lips 36 and 38, respectively, of the eyelet 26. This embodiment is useful when aesthetic considerations make it desirable to cover the plastic strips 30 and 32, respectively, with the backing material 40. As shown in FIG. 8, a large portion of the backing material body 40 is still bonded to the rear side 18 of the facing material body 12. However, the backing material pleat segments 41 are adhesively bonded to the outer surfaces of plastic strips 30 and 32, respectively, instead of to the facing material pleat segments 17. An element and layer breakdown of the pleat 16 of this configuration is as follows: a backing material pleat segment 41; an adhesive layer 42; a plastic strip 30; an adhesive layer 42; a facing material pleat segment 17; a second facing material pleat segment 17; an adhesive layer 42; a plastic strip 32; an adhesive layer 42; and a backing material pleat segment 41. The top and bottom lips 36, 38 of the eyelet 26 further retain these elements and layers together as shown in FIG. 8. In this configuration, the backing material utilized must be of sufficient strength to prevent it from tearing because a tear may cause it to release from the eyelets' top and bottom lips 36, 38.

The method of manufacture of the shade 10 is simplified by the use of the plastic strips 30 and 32 in conjunction with adhesive layers 42 and the eyelet 26 to retain the pleat in substitution for traditional sewing techniques or slats in slat pockets. During construction, the facing material body 12 is backed by a body of backing material 40 adhesively attached to the rear side 18 of the facing material body 12. Edge borders (not shown) are made by folding back an edge portion of the facing-/backing body and adhering the rear surface of said edge portion to the rear surface of the material/backing body. A portion of the facing/backing material body is folded back into two pleat segments 17, 41 such that the front sides of the pleat segment 17 face towards each other. These facing front sides are adhesively bonded to each other. Holes are punched into the pleat segments 17, 41 which correspond with the eyelet holes in plastic strips 30 and 32. The plastic strips are adhesively bonded to the top and bottom outside surfaces 34 of the pleat 16. The eyelets 26 are driven through the holes in the plastic strips 30 and 32 and the facing/backing material pleat segments 17, 41 such that the top and bottom lips 36 engage the plastic strips 34 to further secure the strips to the pleat segments 17. More particularly, the eyelet 26 is driven through the holes until one of its lips engages a plastic strip. The other end of the eyelet 26 has material capable of crushing into the other lip and is so crushed in a conventional manner to engage the other plastic strip.

From the foregoing, the advantages of this invention are readily apparent. A Roman shade has been made which is of simple construction and obviates the need for sewing, yet is precise and durable because its pleats are held by plastic strips secured to the pleats with adhesive and retained by eyelets which precisely maintain the pleats. In one form of the invention all of the pleat segment layers, including the facing material and backing material layers, are enclosed by the plastic strips and retained thereby. In another form of the present invention, the backing material layer is not enclosed by the plastic strips but covers the plastic strips or aesthetic purposes and is secured to the plastic strips by adhesive and the eyelet top and bottom lips.

This invention has been described in detail with reference to particular embodiments thereof, but it will be understood that various other modifications can be effected within the spirit and scope of this invention.

I claim:

1. A pleated Roman shade for hanging from a shade header having an internal pulley system comprising:

a flexible facing body extending from said shade header comprising a plurality of fabric panels, each said fabric panel having a front facing side and a rear side, and in use, capable of extending into a generally vertically planar surface and folding into a flexible loop shape;

a plurality of horizontally extending vertically spaced pleats, each said pleat extending rearwardly from in between adjacent pairs of said fabric panels and including first and second pleat segments formed from said flexible facing body with each segment's facing side facing the inside of each said pleat and each segment's rear side facing the outside of each said pleat such as to form an outside surface of the pleat;

polymer based retaining means adhesively secured to said outside surfaces of each said pleat along the pleat's length for holding each pleat's two pleat segments together from the pleat's outside surfaces to rigidly maintain said pleat, said retaining means including first and second strips having a plurality of vertically aligned openings corresponding to one another, said first strip adhesively secured to said outside surface of said first pleat segment and said second strip adhesively secured to said outside surface of said second pleat segment, and an eyelet extending through each of said aligned openings in said strips, said eyelets having first and second ends, said first end of each eyelet having a first engaging surface extending therefrom for engaging said first strip, said second end having a second engaging surface extending therefrom for engaging said second strip, said engaging surfaces further securing said strips to said pleat segments to rigidly maintain said pleat; and at least one drawstring cooperating with the pulley system and extending through said eyelets in said rearwardly extending pleats for lowering and raising said shade by folding said fabric panels into flexible loop shapes.

2. A pleated Roman shade, as claimed in claim 1, further including:

a flexible backing body comprising a plurality of backing panels, each said backing panel having a forward side adhesively secured to a corresponding rear side of a fabric panel, and an opposite back side, and in use, capable of extending into a generally vertical planar surface and folding into a flexible loop shape, said rear side of each said backing panel thereby forming the outside surfaces of each said pleat and held within said retaining means with said retaining means adhesively secured thereto.

3. A pleated Roman shade, as claimed in claim 1, further including:

a flexible backing body comprising a plurality of backing panels, each backing panel capable, in use, of extending into a generally vertical planar surface and folding into a flexible loop shape, each said backing panel having a forward side including a first portion adhesively secured to a corresponding rear side of a fabric panel and a second portion adhesively secured over said retaining means thereby covering said retaining means, said second portion being engaged by said engaging surfaces of said eyelets to further secure said second portion over said retaining means.

4. A pleated Roman shade, as claimed in claim 2, further including:

edge borders of said facing and backing bodies comprised of back folded edge portions of said facing and backing panels adhesively secured to themselves and/or each other.

5. A pleated Roman shade for hanging from a shade header having an internal pulley system comprising:

a flexible facing body extending from said shade header comprising a plurality of fabric panels, each of said fabric panels having a front facing side and a rear side, and capable of extending into a generally vertically planar surface and folding into a flexible loop shape;

a flexible backing body comprising a plurality of backing panels, each said backing panel having a forward side at least partially adhesively secured to a corresponding rear side of a fabric panel, and an opposite back side, and capable of extending into a generally planar surface and folding into a flexible loop shape;

a plurality of horizontally extending vertically spaced pleats, each said pleat extending rearwardly from in between adjacent pairs of said fabric panels and including a first and a second pleat segment formed from said flexible facing body with each segment's facing side facing towards the other's inside of each said pleat, each said pleat segment further having an outside surface;

polymer based retaining means adhesively secured to said outside surface of each said pleat segment along the pleat's length for holding each pleat segment pair together from said outside surfaces to rigidly maintain said pleat, said retaining means including first and second strips having a plurality of vertically aligned openings corresponding to one another, said first strip adhesively secured to said outside surface of said first pleat segment and said second strip adhesively secured to said outside surface of said second pleat segment, and an eyelet extending through each of said aligned openings in said strips, said eyelets having first and second ends, said first end of each eyelet having a first engaging surface extending therefrom for engaging said first strip, said second end having a second engaging surface extending therefrom for engaging said second strip, said engaging surfaces further securing said strips to said pleat segments to rigidly maintain said pleat; and at least one drawstring cooperating with the pulley system and extending through said eyelets in said rearwardly extending pleats for lowering and raising said shade by folding said fabric panels into flexible loop shapes.

6. A Roman Shade, as claimed in claim 5, wherein:
said forward side of each said backing panel is fully adhesively secured to a corresponding rear side of a fabric panel such that said backing panel's back side comprises the outside surfaces of its respective pleat segments.

7. A Roman Shade, as claimed in claim 5, wherein:
each said backing panel's forward side includes a first portion adhesively secured to a corresponding rear side of a fabric panel and a second portion adhesively secured over said retaining means thereby covering said first and second strips, the back side of said second portion being engaged by said engaging surfaces of said eyelets to further secure said second portion over said retaining means.

8. A Roman Shade, as claimed in claim 7, further including:
edge borders of said facing and backing bodies comprised of back folded edge portions of said facing and backing panels adhesively secured to themselves and/or each other.

9. A method of constructing a Roman Shade comprising the steps of:
providing a shade header having an internal pulley system;
providing a flexible facing body comprising a plurality of fabric panels, each of the fabric panels having a front facing side and a rear side, and capable of extending into a generally planar-surface and folding into a flexible loop shape;
providing a flexible backing body comprising a plurality of backing panels, each of the backing panels having a forward side corresponding to the rear side of a respective fabric panel, and an opposite back side, and capable of extending into a generally planar surface and folding into a flexible loop shape;
providing a suitable adhesive;
adhesively securing he forward side of each flexible backing panel to the rear side of a respective fabric facing panel;
folding the fabric facing panels into pleat segments having an outside surface to form a plurality of horizontally extending vertically spaced pleats extending rearwardly from in between adjacent pairs of the panels with each segment's facing side facing towards the other's inside of each said pleat;
providing polymer based retaining means for holding each pleat segment pair together from the pleat segment's outside surfaces to rigidly maintain the pleat, the retaining means including first and second strips having a plurality of vertically aligned openings corresponding to one another;
adhesively securing the first strip to the outside surface of the first pleat segment;
adhesively securing the second strip to the outside surface of the second pleat segment;
providing a plurality of eyelets having two ends, a first engaging surface extending from the first end and material extending from the second end for a second engaging surface;
punching openings in the pleat segments corresponding with the openings in the strips;
pushing an eyelet through each of the corresponding openings in the first strip, the pleat segments and the second strip so that the first engaging surface engages the first strip;
crushing the material extending from the second end of the eyelets to form a second engaging surface engaging the second strip to interconnect the strips and further secure the strips to the outside surfaces of the pleat segments;
providing at least one drawstring for cooperating with the pulley system;
connecting the drawstring to the pulley system;
extending the drawstring through a column of corresponding eyelets in the rearwardly extending pleats for lowering and raising the shade by folding the fabric panels into flexible loop shapes; and
connecting the flexible facing body to the shade header.

10. A method of constructing a Roman Shade, as claimed in claim 9, wherein the step of adhesively securing the forward side of each flexible backing panel to the rear side of a respective fabric facing panel includes;
adhesively securing the entire forward side of each backing panel to its corresponding fabric panel's rear side such that the backing panel's back side comprises the outside surfaces of its respective pleat segments.

11. A method of constructing a Roman Shade, as claimed in claim 9, wherein:
the step of adhesively securing the forward side of each flexible backing panel to the rear side of a respective fabric facing panel includes
adhesively securing a first portion of each backing panel's forward side to its corresponding fabric panel's rear side, and
adhesively securing a second portion of each backing panel's forward side over the retaining means to cover the first and second strips;
the step of punching openings further includes
punching openings in the second portion of each backing panel corresponding with the openings in the strips; and
the step of pushing an eyelet further includes
pushing the eyelet through the back side of the second portion such that the engaging surfaces of the eyelets further secure the second portion over the retaining means.

* * * * *